US007718217B2

(12) United States Patent
Kamata et al.

(10) Patent No.: US 7,718,217 B2
(45) Date of Patent: May 18, 2010

(54) METHOD AND APPARATUS FOR MARKING ELECTRIC WIRE

(75) Inventors: Takeshi Kamata, Shizuoka (JP); Shigeharu Suzuki, Shizuoka (JP); Keigo Sugimura, Shizuoka (JP); Kiyoshi Yagi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 1037 days.

(21) Appl. No.: 10/523,980

(22) PCT Filed: Aug. 6, 2003

(86) PCT No.: PCT/JP03/09992

§ 371 (c)(1),
(2), (4) Date: Nov. 3, 2005

(87) PCT Pub. No.: WO2004/015721

PCT Pub. Date: Feb. 19, 2004

(65) Prior Publication Data

US 2006/0110527 A1 May 25, 2006

(30) Foreign Application Priority Data

Aug. 9, 2002 (JP) ..... 2002-233730

(51) Int. Cl.
*B05D 5/12* (2006.01)

(52) U.S. Cl. ..... 427/117; 427/118

(58) Field of Classification Search ..... 427/117, 427/118; 174/110 R

See application file for complete search history.

(56) References Cited

U.S. PATENT DOCUMENTS 2,428,284 A * 9/1947 Krogel ..... 118/314
2,766,136 A * 10/1956 Gray ..... 427/118
2,981,225 A * 4/1961 Vatt et al. ..... 118/65

(Continued)

FOREIGN PATENT DOCUMENTS

FR 2 373 835 7/1978

(Continued)

OTHER PUBLICATIONS

Supplementary European Search Report dated Jan. 9, 2007.

*Primary Examiner*—Brian K Talbot
(74) *Attorney, Agent, or Firm*—Kratz, Quintos & Hanson, LLP

(57) ABSTRACT

An object of the present invention is to provide a method and an apparatus for marking an electric wire at a low cost. An apparatus 1 for marking an electric wire forms a band mark 21 on a part of an outer face 5*a* of the electric wire 3. The band mark 21 is formed along the entire circumference of the part of the outer face 5*a* of the electric wire 3. The marking apparatus 1 tightens the electric wire 3 in a state where a tensile force is applied in a longitudinal direction. The marking apparatus 1 includes a nozzle 35 for injecting coloring agent toward an uppermost position 10 of the outer face 5*a* of the electric wire 3. The nozzle 35 has an open end 42 which is opposed to the electric wire 3 and capable of passing the coloring agent. A straight line L extending between a center C1 of the open end 42 and a center C2 of the electric wire 3 lies along a vertical direction.

3 Claims, 6 Drawing Sheets

U.S. PATENT DOCUMENTS

| | | | | | |
|---|---|---|---|---|---|
| 3,638,612 | A * | 2/1972 | Haise et al. | ..... | 118/625 |
| 4,877,645 | A * | 10/1989 | Bleich et al. | ..... | 427/117 |
| 5,153,025 | A * | 10/1992 | Klebl et al. | ..... | 427/118 |
| 5,444,466 | A * | 8/1995 | Smyczek et al. | ..... | 347/4 |
| 6,605,049 | B1 * | 8/2003 | Wagner et al. | ..... | 600/585 |

FOREIGN PATENT DOCUMENTS

| | | |
|---|---|---|
| JP | 5-217435 | 8/1993 |
| JP | 10-31918 | 2/1998 |

* cited by examiner

METHOD AND APPARATUS FOR MARKING ELECTRIC WIRE

TECHNICAL FIELD

The present invention relates to a method and an apparatus for marking an electric wire, and more particularly to the method and apparatus for marking an outer face of the electric wire which includes a core wire and an insulating sheath covering the core wire.

BACKGROUND ART

Various types of electronic units are mounted on a motor car as a moving body. The motor car is provided with wire harnesses for the purpose of transmitting electric power from a power source, and control signals and so on from a computer or the like to the electronic units. Each of the wire harnesses includes a plurality of electric wires, and a plurality of connectors to be attached to ends of the electric wires.

The electric wire is composed of an electrically conductive core wire and a sheath made of insulating synthetic resin for covering the core wire. The electric wire is a so-called sheathed wire. The connector is provided with electrically conductive terminal metals and an insulating connector housing. The terminal metals are fixed to the ends of the electric wires so as to be electrically connected with the core wires of the electric wires. The connector housing is formed in a box-like shape and contains the terminal metals.

On occasion of assembling the above described wire harness, the electric wires are cut into a predetermined length as a first step, and then, the terminal metals are fixed to the ends of the electric wires. A plurality of the electric wires are connected to each other, according to necessity. Thereafter, the terminal metals are inserted into the connector housing. The wire harness can be assembled in this manner.

It is necessary to identify the electric wires of the above described wire harness with respect to a size of the core wire, material of the sheath (the material may vary depending on presence of heat resisting property or so), an object for use, etc. The object for use means, for example, an air bag, an ABS (Antilock Brake System), a power transmitting system, and a system of the motor car in which the electric wires for transmitting control signals including vehicle speed information etc. are employed.

Conventionally, the electric wire for the wire harness has been provided with a ring-like band mark in a part of its outer face along an entire circumference thereof, in order to identify the objects for use (systems), as described above. For this purpose, it has been conventionally accustomed that when synthetic resin is extruded to form the sheath around the core wire, coloring agent of a desired color is admixed to the synthetic resin. Then, another coloring agent which has different color from the aforesaid coloring agent is applied to a part of the synthetic resin which has covered the core wire, that is, the outer face of the sheath, along an entire circumference thereof. In this manner, the part of the outer face of the sheath has been colored along the entire circumference thereof to form the band mark on the electric wire.

In a process for forming the band mark on the above described electric wire, the coloring agent has been applied to the outer face of the electric wire by blowing it together with a pressurized air, as an aerosol. On this occasion, a plurality of nozzles have been employed for blowing the coloring agents, and these nozzles have been arranged along a circumferential direction of the electric wire at a substantially equal interval.

A plurality of the nozzles have been conventionally employed as described above. Therefore, there has been such a problem that an apparatus for marking the electric wire has become large-sized requiring a larger space for installation, and that a production cost for the apparatus has been increased. This would incur a rise of the overall cost for marking the electric wire.

In view of the above, an object of the present invention is to provide a method and an apparatus for marking an electric wire which can be offered at a low cost.

DISCLOSURE OF THE INVENTION

In order to solve the above described problem and attain the object, there is provided, according to the present invention, a method for marking an electric wire which includes an electrically conductive core wire and an insulating sheath by injecting a certain amount of coloring agent to an outer face of the electric wire, wherein the electric wire is tightened in a state where a tensile force is applied in a longitudinal direction, and the coloring agent is injected from an upper side of the electric wire to an upper part of the outer face of the electric wire.

According to the above described aspect of the invention, the electric wire is tightened with the tensile force, and therefore, positional displacement of the electric wire can be prevented. As the results, the coloring agent which has been injected toward the upper part of the outer face of the electric wire can be reliably adhered to this upper part. The coloring agent which has been adhered to the upper part of the electric wire moves downward by gravity in a state adhered to the outer face of the electric wire.

For this reason, by providing only one means or mechanism for injecting the coloring agent, it is possible to adhere the coloring agent to a part of the outer face of the electric wire along the entire circumference thereof.

In the method for marking an electric wire according to the inventor, the coloring agent is injected toward an area including the uppermost position of the outer face of the electric wire.

According to the above described aspect, the coloring agent is injected toward an area located at the uppermost position of the electric wire. Therefore, the coloring agent which has been adhered to the electric wire reliably moves downward by gravity in a state adhered to the outer face of the electric wire. For this reason, by providing only one means or mechanism for injecting the coloring agent, it is possible to adhere the coloring agent to a part of the outer face of the electric wire along the entire circumference thereof.

In the method for marking an electric wire according to the inventor, the coloring agent is injected through an open end which is opposed to the outer face of the electric wire, and a line extending between a center of the open end and a center of the electric wire lies along a vertical direction.

According to the above described aspect, the line extending between the center of the open end and the center of the electric wire lies along a vertical direction. Therefore, the open end is positioned right above the electric wire. As the results, the coloring agent is reliably adhered to the uppermost position of the electric wire. Therefore, the coloring agent which has been adhered to the electric wire moves downward more reliably by gravity in a state adhered to the outer face of the electric wire. For this reason, by providing only one means or mechanism for injecting the coloring agent, it is possible to adhere the coloring agent to a part of the outer face of the electric wire along the entire circumference thereof more reliably. It is to be noted that the vertical direction is the direction of the gravity.

According to the present invention, there is further provided an apparatus for marking an electric wire which includes an electrically conductive core wire and an insulating sheath, by injecting a certain amount of coloring agent to an outer face of the electric wire, the apparatus comprising tightening means for tightening the electric wire in a state where a tensile force is applied in a longitudinal direction, and injecting means provided above the electric wire which is tightened by the tightening means, and adapted to inject the coloring agent, wherein the injecting means injects the coloring agent from an upper side of the electric wire to an upper part of the outer face of the electric wire.

According to the above described aspect, the electric wire is tightened by the tightening means, and therefore, positional displacement of the electric wire can be prevented. The injecting means is positioned above the electric wire and injects the coloring agent toward the upper part of the electric wire. As the results, the coloring agent can be reliably adhered to the upper part of the electric wire. The coloring agent which has been adhered to the upper part of the electric wire moves downward by gravity in a state adhered to the outer face of the electric wire. For this reason, by providing only one injecting means, it is possible to adhere the coloring agent to a part of the outer face of the electric wire along the entire circumference thereof.

In the apparatus for marking an electric wire according to the invention, the coloring agent is injected toward an area including the uppermost position of the outer face of the electric wire.

According to the above described aspect, the injecting means injects the coloring agent toward an area located at the uppermost position of the electric wire. Therefore, the coloring agent which has been adhered to the electric wire reliably moves downward by gravity in a state adhered to the outer face of the electric wire. For this reason, by providing only one means or mechanism for injecting the coloring agent, it is possible to adhere the coloring agent to a part of the outer face of the electric wire along the entire circumference thereof.

In the apparatus for marking an electric wire according to the invention, the injecting means includes an open end which is opposed to the outer face of the electric wire, whereby the coloring agent is injected through the open end, and a line extending between a center of the open end and a center of the electric wire lies along a vertical direction.

According to the above described aspect, the line extending between the center of the open end of the injecting means and the center of the electric wire lies along a vertical direction. Therefore, the open end of the injecting means is positioned right above the electric wire. As the results, the coloring agent can be reliably adhered to the uppermost position of the electric wire. Therefore, the coloring agent which has been adhered to the electric wire moves downward by gravity in a state adhered to the outer face of the electric wire, more reliably. For this reason, by providing only one means or mechanism for injecting the coloring agent, it is possible to adhere the coloring agent to a part of the outer face of the electric wire along the entire circumference thereof.

The above described coloring agent is liquid material consisting of color material (organic substance for industrial purpose) which is dissolved or dispersed in water or other solvent. As the organic substance, the coloring agent includes dyes and pigments which are generally composites of the organic substances. The dyes may be used as the pigments, or the pigments may be used as the dyes according to cases. As more specific examples, the coloring agent in the claims means both coloring liquid and paint. The coloring liquid means the dye which is dissolved or dispersed in the solvent, while the paint means the pigment which is dispersed in dispersion liquid. Therefore, when the coloring liquid has been adhered to the outer face of the sheath, the dye will be infiltrated into the sheath. On the other hand, when the paint has been adhered to the outer face of the sheath, the pigment will not be infiltrated into the sheath, but simply adhered to the outer face. Therefore, the method for marking the outer face of the sheath includes both dyeing a part of the outer face of the sheath with the dye, and applying the pigment to the part of the outer face of the sheath.

Preferably, the aforesaid solvent and dispersion liquid is compatible with the synthetic resin which forms the sheath. In this case, the dye can be reliably infiltrated into the sheath, and the pigment can be reliably adhered to the outer face of the sheath.

BEST MODE FOR CARRYING OUT THE INVENTION

Now, a first embodiment of the present invention will be described referring to FIGS. 1 to 6.

Figure 1:
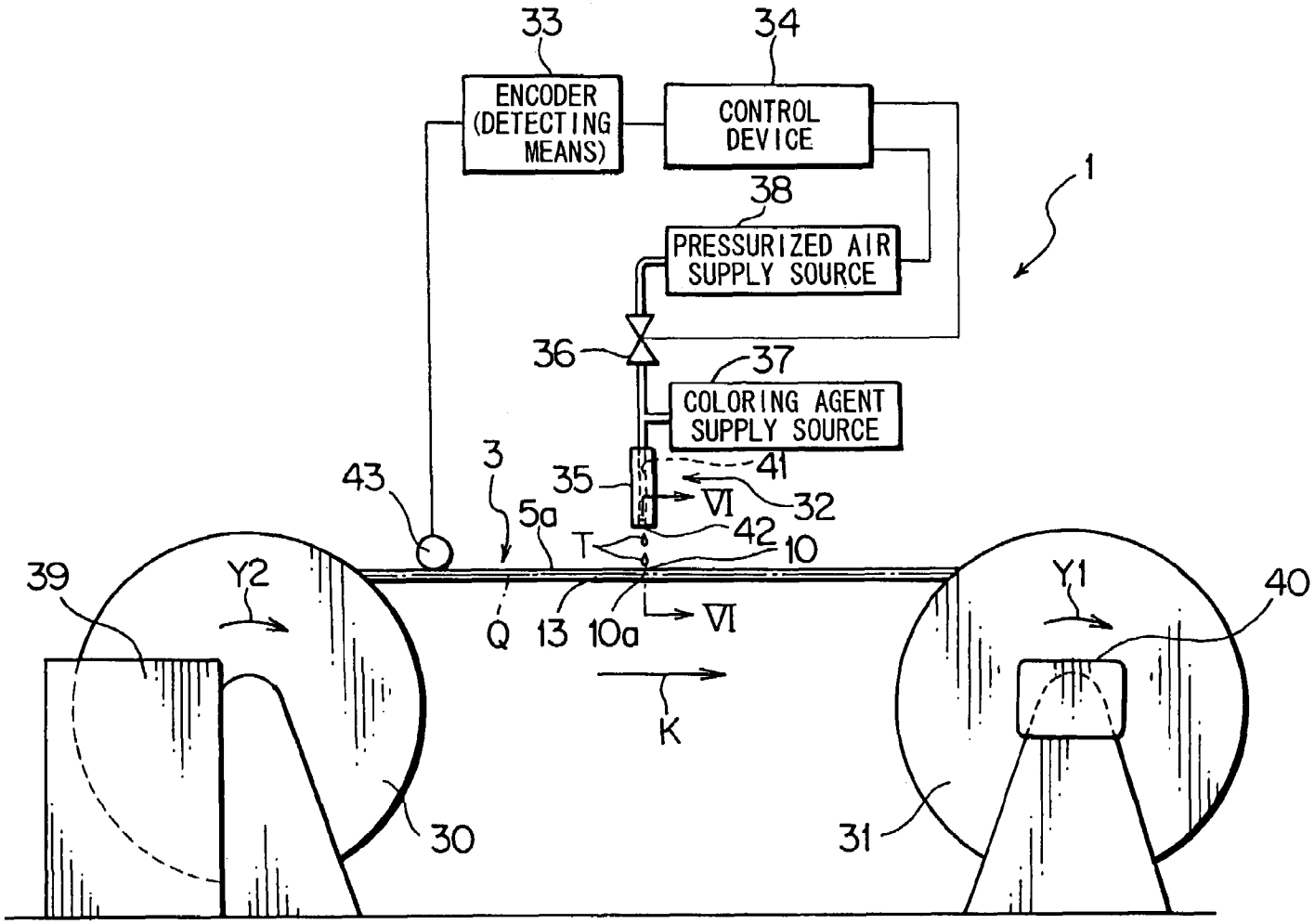
FIG. 1 is an explanatory diagram showing a structure of an apparatus for marking an electric wire according to a first embodiment of the present invention.

An apparatus 1 for marking an electric wire (hereinafter simply referred to as "a marking apparatus") in FIG. 1 is employed for forming a ring-like band mark 21 on a part of an outer face 5*a* of a sheath 5 of an electric wire 3, along an entire circumference thereof, as shown in FIGS. 2 to 5. In short, the marking apparatus 1 marks the outer face 5*a* of the sheath 5 of the electric wire 3.

Figure 2:
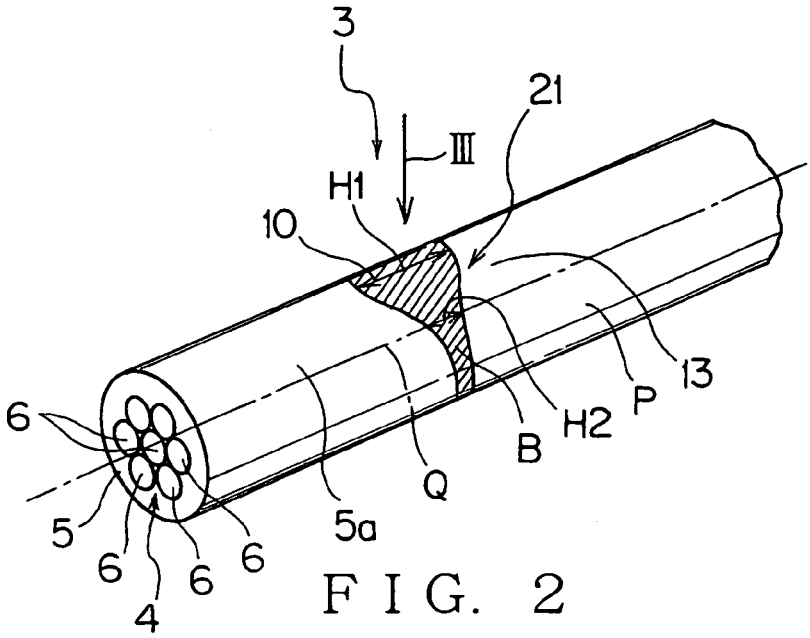
FIG. 2 is a perspective view of the electric wire which has been marked by the apparatus for marking an electric wire as shown in FIG. 1.

The electric wire 3 is one component of a wire harness to be arranged in an automobile as a moving body. The electric wire 3 includes, as shown in FIG. 2, a core wire 4 having electrical conductivity, and the insulating sheath 5. The core wire 4 is formed of a plurality of material wires 6 twisted together. The material wires 6 composing the core wire 4 are made of electrically conductive metal. The sheath 5 is formed of, for example, synthetic resin such as polyvinyl chloride (PVC). Since the sheath 5 covers the core wire 4, the outer face 5*a* of the sheath 5 can be deemed as an outer face of the electric wire 3.

The sheath 5 has a single color P. In order to give the single color P to the outer face 5*a* of the electric wire 3, coloring agent having a desired color may be admixed to the synthetic resin which will form the sheath 5, or the synthetic resin may not be mixed with the coloring agent so that the color of the synthetic resin itself may constitute the single color P. In case where the color of the synthetic resin itself is the single color P with no coloring agent mixed to the synthetic resin, the outer face 5*a* of the sheath, that is, the outer face of the electric wire 3 is called as colorless. In this manner, the term "colorless" means that the outer face 5*a* of the electric wire 3 has the color of the synthetic resin itself without mixing the coloring agent into the synthetic resin.

The ring-like band mark 21 as shown in FIGS. 2 to 5 is formed in a part of the outer face 5*a* of the electric wire 3. The band mark 21 has a color B (represented by paralleled diagonal lines in FIGS. 2 to 5). The color B is different from the above described single color P of the outer face 5*a* of the sheath 5.

Figure 3:
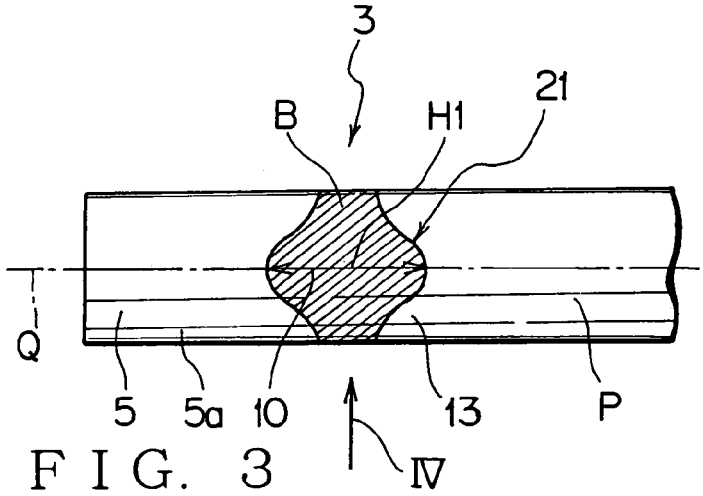
FIG. 3 is a plan view of the electric wire as seen in a direction of an arrow mark III in FIG. 2.
Figure 5:
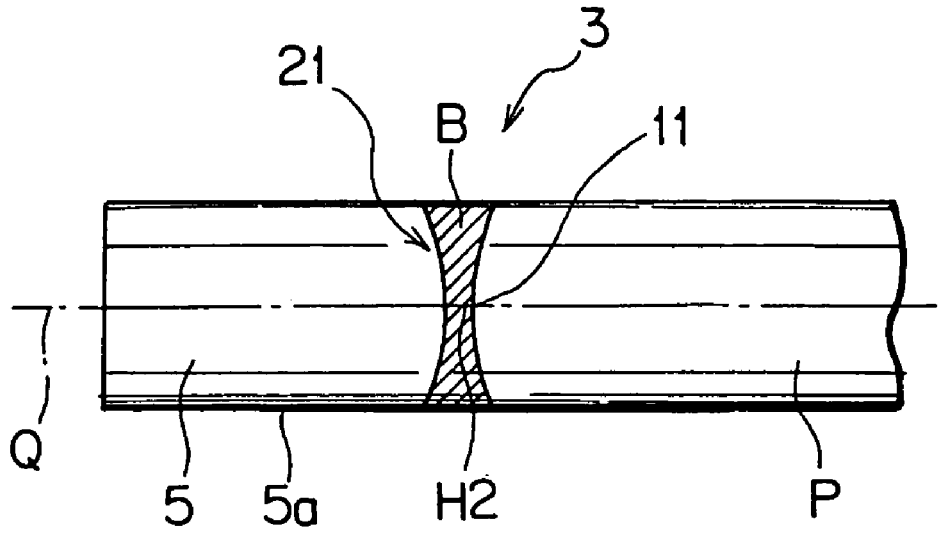
FIG. 5 is a bottom view of the electric wire as seen in a direction of an arrow mark V in FIG. 4.

The band mark 21 is formed on a part of the outer face 5*a* of the sheath 5 along the entire circumference of the electric wire 3. As shown in FIG. 3, the band mark 21 has the largest width H1 in a longitudinal direction of the electric wire 3, at the uppermost position 10 in FIG. 2, in a part of the outer face 5*a* of the sheath 5. On the other hand, as shown in FIG. 5, the band mark 21 has the smallest width H2 in a longitudinal direction of the electric wire 3, at the lowermost position 11 in FIG. 2, in the part of the outer face 5*a* of the sheath 5.

Figure 4:
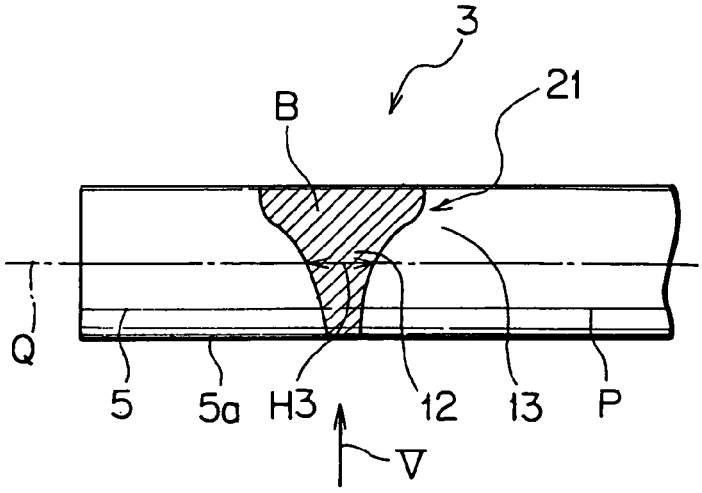
FIG. 4 is a side view of the electric wire as seen in a direction of an arrow mark IV in FIG. 3.

As shown in FIG. 4, the band mark 21 has a width H3 which is larger than the width H2 and smaller than the width H1 in a longitudinal direction of the electric wire 3, at lateral positions 12 in FIG. 2, in the part of the outer face 5*a* of the sheath 5. In this manner, the band mark 21 is formed to have the widths H1, H3, H2 in a longitudinal direction (along an axis Q represented by an alternate long and short dash line in FIG. 2) of the electric wire 3 which become gradually narrower from above to below in the part of the outer face 5*a* of the electric wire 3.

A plurality of the electric wires 3 having the above described structure are provided with connectors or so at their ends, and bundled into one to form the above described wire harness. The connectors are coupled to connectors of the electronic units of various types in the automobile or the like, and the wire harness, that is, a group of the electric wires 3 transmit various signals or electric power to the electronic units.

Moreover, by changing the color B of the above described band mark 21 into various different colors, the electric wires 3 can be identified from one another. The color B of the band mark 21 is used for identifying the electric wires 3 with respect to types, systems, etc. In other words, the color B of the band mark 21 represents an object for use of the electric wire 3 of the wire harness, and at the same time, enables the object for use to be identified.

The marking apparatus 1 is an apparatus for forming the above described band mark 21 on a part of the outer face 5*a* of the electric wire 3. The marking apparatus 1 includes, as shown in FIG. 1, a feeding reel 30 as feeding means, and a take-up reel 31 as take-up means, a brake 39 as tightening means, an injecting unit 32, an encoder 33 as detecting means, and a control device 34. The feeding reel 30 and the take-up reel 31 are rotatably installed with a space from each other on a floor of a factory or the like.

The electric wire 3 is wound around the feeding reel 30, and fed to the take-up reel 31. The take-up reel 31 takes up the electric wire 3 which has been fed from the feeding reel 30. The take-up reel 31 is provided with a motor 40, and rotates in a direction of an arrow mark Y1 in FIG. 1 by driving force of the motor 40. The feeding reel 30 is not provided with a motor, and rotates in a direction of an arrow mark Y2 in FIG. 1 by being pulled by the electric wire 3, when the take-up reel 31 takes up the electric wire 3 while rotating in the direction of the arrow mark Y1 in FIG. 1. It is to be noted that the directions of the arrow mark Y1 and the arrow mark Y2 are in the same direction.

When the above described motor 40 is driven to rotate and the take-up reel 31 rotates in the direction of the arrow mark Y1, the electric wire 3 moves in a longitudinal direction thereof, that is, along an axis Q of the electric wire 3 which is represented by an arrow mark K in FIG. 1.

The brake 39 is fixed to both the feeding reel 30 and the floor. When the feeding reel 30 rotates, the brake 39 applies a friction force to the feeding reel 30 so as to hinder the rotation of the feeding reel 30. For this reason, the brake 39 tends to decrease number of the rotation of the feeding reel 30 as compared with number of the rotation of the take-up real 31. Consequently, a tensile force in a longitudinal direction will be applied to the electric wire 3 which is stretched between the feeding reel 30 and the take-up reel 31. In other words, the brake 39 keeps the electric wire 3 tightened in a state where the tensile force is applied in a longitudinal direction.

The injection unit 32 is provided between the feeding reel 30 and the take-up reel 31 as shown in FIG. 1. The injection unit 32 includes a nozzle 35 as injecting means, and a valve 36.

The nozzle 35 is arranged above the electric wire 3 which is moving along the direction of the arrow mark K by means of the feeding reel 30 and the take-up reel 31. The nozzle 35 has a nozzle hole 41 for allowing coloring agent T (See FIG. 1) to pass therethrough. An open end 42 of the nozzle hole 41 is opposed to the electric wire 3 which is moving along the direction of the arrow mark K by means of the feeding reel 30 and the take-up reel 31.

Thus, the nozzle 35 is provided with the open end 42 which is opposed to the electric wire 3. The coloring agent T is supplied from a coloring agent supply source 37 into the nozzle hole 41 of the nozzle 35. The coloring agent T has the above described color B.

Figure 6:
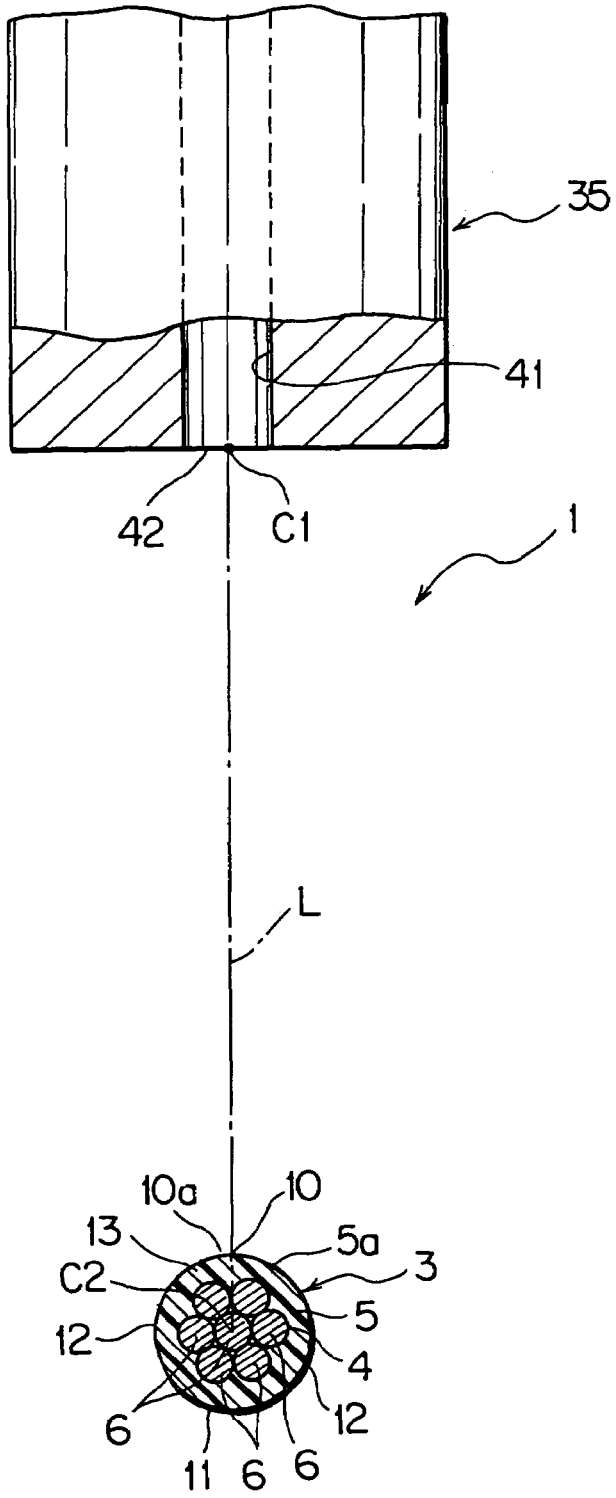
FIG. 6 is a sectional view taken along a line VI-VI in FIG. 1.

As shown in FIG. 6, a straight line L (represented by an alternate long and short dash line in FIG. 6) extending between a center C1 of the open end 42 of the nozzle 35 and a center C2 of the electric wire 3 lies along a vertical direction. The vertical direction represents a direction of gravity. Therefore, the open end 42 of the nozzle 35 is positioned right above the electric wire 3.

The valve 36 is connected to the nozzle 35, and a pressurized air supply source 38 is further connected to the valve 36. The pressurized air supply source 38 supplies pressurized air to the nozzle 35 by way of the valve 36. When the valve 36 is opened, the coloring agent T in the nozzle hole 41 of the nozzle 35 is injected through the open end 42 toward the uppermost position 10 of the outer face 5*a* of the electric wire 3, with an aid of the pressurized air supplied from the pressurized air supply source 38.

For this purpose, the nozzle 35 injects (injects in drops) the coloring agent T toward an area 10*a* including the uppermost position 10 of the outer face 5*a* of the electric wire 3. In short, the nozzle 35 injects (injects in drops) the coloring agent T toward an upper half 13 of the electric wire 3, thereby allowing the coloring agent T to be adhered to the aforesaid area 10*a* including the uppermost position 10 of the outer face 5*a* of the electric wire 3.

When the valve 36 is closed, injection (injection in drops) of the coloring agent T from the nozzle 35 is stopped. As the injection unit 32 has the above described structure, the valve 36 is kept open for a predetermined period according to signals from the control device 34, thereby to inject (inject in drops) a determined amount of the coloring agent T to the outer face 5*a* of the electric wire 3.

The above described coloring agent T is liquid material consisting of color material (organic substance for industrial purpose) dissolved or dispersed in water or other solvent. As the organic substance, the coloring agent T includes dyes and pigments which are generally composites of the organic substances. The dyes may be used as the pigments, or the pigments may be used as the dyes according to cases. More specifically, the coloring agent T is in a form of coloring liquid or paint. The coloring liquid means the dye dissolved or dispersed in the solvent, while the paint means the pigment dispersed in dispersion liquid. Therefore, when the coloring liquid has been adhered to the outer face 5*a* of the electric wire 3, the dye will be infiltrated into the sheath 5. On the other hand, when the paint has been adhered to the outer face 5*a* of the electric wire 3, the pigment will not be infiltrated into the sheath 5, but simply adhered to the outer face 5*a*.

In other words, the injection unit 32 serves to dye a part of the outer face 5*a* of the electric wire with the dye, or alternatively, to apply the pigment to the part of the outer face 5*a* of the electric wire 3. Therefore, a method for marking the outer face 5*a* of the electric wire includes both dyeing a part of the outer face 5*a* of the electric wire with the dye, and applying the pigment to the part of the outer face 5*a* of the electric wire 3.

Preferably, the aforesaid solvent and dispersion liquid is compatible with the synthetic resin which forms the sheath 5. In this case, the dye can be reliably infiltrated into the sheath 5, and the pigment can be reliably adhered to the outer face 5*a* of the sheath 5.

The phrase "injection in drops" means that a certain amount of the coloring agent in a liquid form is injected with force, in a form of drops, from the nozzle 35 of the injection unit 32 toward the outer face 5*a* of the electric wire 3. Accordingly, in the marking apparatus 1 of the present embodiment, the nozzle 35 of the injection unit 32 injects with force a certain amount of the coloring agent which has been in a form of liquid and changed into a form of drops toward the outer face 5*a* of the electric wire 3.

The encoder 33 has a rotor 43 as shown in FIG. 1. The rotor 43 can rotate around an axis of rotation. An outer peripheral face of the rotor 43 is in contact with the outer face 5*a* of the electric wire 3 which is forced to move along the direction of the arrow mark K by means of a pair of the reels 30, 31. When the core wire 4, that is, the electric wire 3 runs (moves) in the direction of the arrow mark K, the rotor 43 rotates. In short, the rotor 43 rotates around its axis of rotation along with the running (moving) of the core wire 4, that is, the electric wire 3 along the direction of the arrow mark K. It is apparent that number of the rotation of the rotor 43 is in direct proportion to a moving distance of the electric wire 3 along the direction of the arrow mark K.

The encoder 33 is connected to the control device 34. When the rotor 43 rotates by a predetermined angle, the encoder 33 outputs pulse signals to the control device 34. More specifically, the encoder 33 outputs information corresponding to moving velocity of the core wire 4, that is, the electric wire 3 along the direction of the arrow mark K. In this manner, the encoder 33 measures the information corresponding to the moving velocity of the electric wire 3, and outputs the information to the control device 34. By thus outputting the pulse signals, the encoder 33 detects a determined position of the electric wire 3. This determined position is desirably such a position that the nozzle 35 of the injection unit 32 may start to inject the coloring agent T, in order to mark the electric wire 3 while it is moving. Usually, the encoder 33 outputs pulse signals according to a moving amount of the electric wire 3 by friction between the electric wire 3 and the rotor 43 of the encoder 33. However, in case where the moving amount is inconsistent with number of the pulse signals, depending on condition of the outer face 5*a* of the electric wire 3, it would be possible to obtain the information of the moving velocity in other places, and to feedback the information for comparative calculation.

The control device 34 is a computer provided with known RAM, ROM, CPU, and so on. The control device 34 interconnects the motor 40 of the take-up reel 31, the encoder 33, the valve 36, the pressurized air supply source 38, and so on, thereby to control all the operations of the marking apparatus 1. An opening degree when the valve 36 is opened, a duration of the opening, and pressure of the pressurized air supplied to the valve 36 from the pressurized air supply source 38 are stored in a memory of the control device 34. Preferably, the above described opening degree, duration of the opening, and pressure are such values that the coloring agent T injected from the nozzle 35 can be adhered to the entire circumference of a part of the outer face 5*a* of the electric wire 3. The control device 34 opens and closes the valve 36 according to the information from the encoder 33 about the moving velocity, in short, the predetermined position of the electric wire 3.

When the marking apparatus 1 having the above described structure forms the band mark 21 on the outer face 5*a* of the electric wire 3, in other words, marks the outer face 5*a* of the electric wire 3, an end of the electric wire 3 which has been spooled around the feeding reel 30 is wound around the take-up reel 31 as a first step. Then, the motor 40 is driven to rotate the take-up reel 31 in the direction of the arrow mark Y1, and also the feeding reel 30 in the direction of the arrow mark Y2. In this manner, the electric wire 3 moves from the feeding reel 30 to the take-up reel 31, and tightened in a state applied with a tensile force, because the friction force is applied to the feeding reel 30 by means of the brake 39.

Thereafter, the pulse signals in a predetermined order are inputted from the encoder 33 into the control device 34. The control device 34 opens the valve 36 at the opening degree which has been stored, and keeps the valve 36 open for the duration of opening which has been stored. On this occasion, the control device 34 supplies the pressurized air from the pressurized air supply source 38 to the nozzle 35 with the pressure stored in the memory. Then, a determined amount of the coloring agent T is injected (injected in drops) toward the outer face 5*a* of the electric wire 3 through the open end 42 of the nozzle hole 41 in the nozzle 35 of the injection unit 32.

The coloring agent T in liquid form is adhered to the area 10*a* including the uppermost position 10 of the outer face 5*a* of the electric wire 3. In other words, the coloring agent T in liquid form is adhered to the upper half 13 of the electric wire 3. The coloring agent T which has been adhered to the outer face 5*a* of the electric wire 3 moves downward by gravity along the outer face 5*a* of the electric wire 3, before the solvent or the dispersion liquid is vaporized. After the coloring agent T has been adhered up to the lower area of the outer face 5*a*, the solvent or the dispersion liquid will be vaporized. Then, the dye or the pigment in the coloring agent T will remain on the outer face 5*a*, and the above described band mark 21 will be formed on the outer face 5*a* of the electric wire 3. Thus, the electric wire 3 having the above described structure can be obtained. In this manner, the band mark 21 will be formed in a form of a colored ring on a part of the outer face 5*a* of the electric wire 3 along the entire circumference thereof.

According to the present embodiment, the electric wire 3 is tightened by means of the brake 39, and therefore, positional displacement of the electric wire 3 can be prevented. The nozzle 35 of the injection unit 32 is located above the electric wire 3, and injects (injects in drops) the coloring agent T in liquid form toward the area 10*a* including the uppermost position 10 of the electric wire 3. As the results, the nozzle 35 of the injection unit 32 can reliably adhere the coloring agent T in liquid form to the area 10*a* including the uppermost position 10 of the electric wire 3. The coloring agent T which has been adhered to the area 10*a* including the uppermost position 10 of the electric wire 3 moves downward by gravity in a state adhered to the outer face 5*a* of the electric wire 3.

For this reason, by providing only one nozzle 35 of the injection unit 32, it is possible to adhere the coloring agent T in liquid form to a part of the outer face 5*a* of the electric wire 3 along the entire circumference thereof. Therefore, the band mark 21 can be formed by providing only one nozzle 35 of the injection unit 32, and so, the marking apparatus 1 for the electric wire can be manufactured at a low cost, and the overall cost for marking the electric wire can be decreased.

In addition, the straight line L extending between the center C1 of the open end 42 of the nozzle hole 41 in the nozzle 35 and the center C2 of the electric wire 3 lies along a vertical direction. Therefore, the open end 42 of the nozzle 35 of the injection unit 32 is positioned right above the electric wire 3. As the results, the nozzle 35 of the injection unit 32 can reliably adhere the coloring agent T to the uppermost position of the electric wire 3.

For this reason, by providing only one nozzle 35 of the injection unit 32, it is possible to more reliably adhere the coloring agent T to a part of the outer face 5*a* of the electric wire 3 along the entire circumference thereof. Therefore, the band mark 21 can be formed by providing only one nozzle 35 of the injection unit 32, and so, the marking apparatus 1 for the electric wire can be manufactured at a low cost, and the overall cost for marking the electric wire can be decreased.

Figure 7:
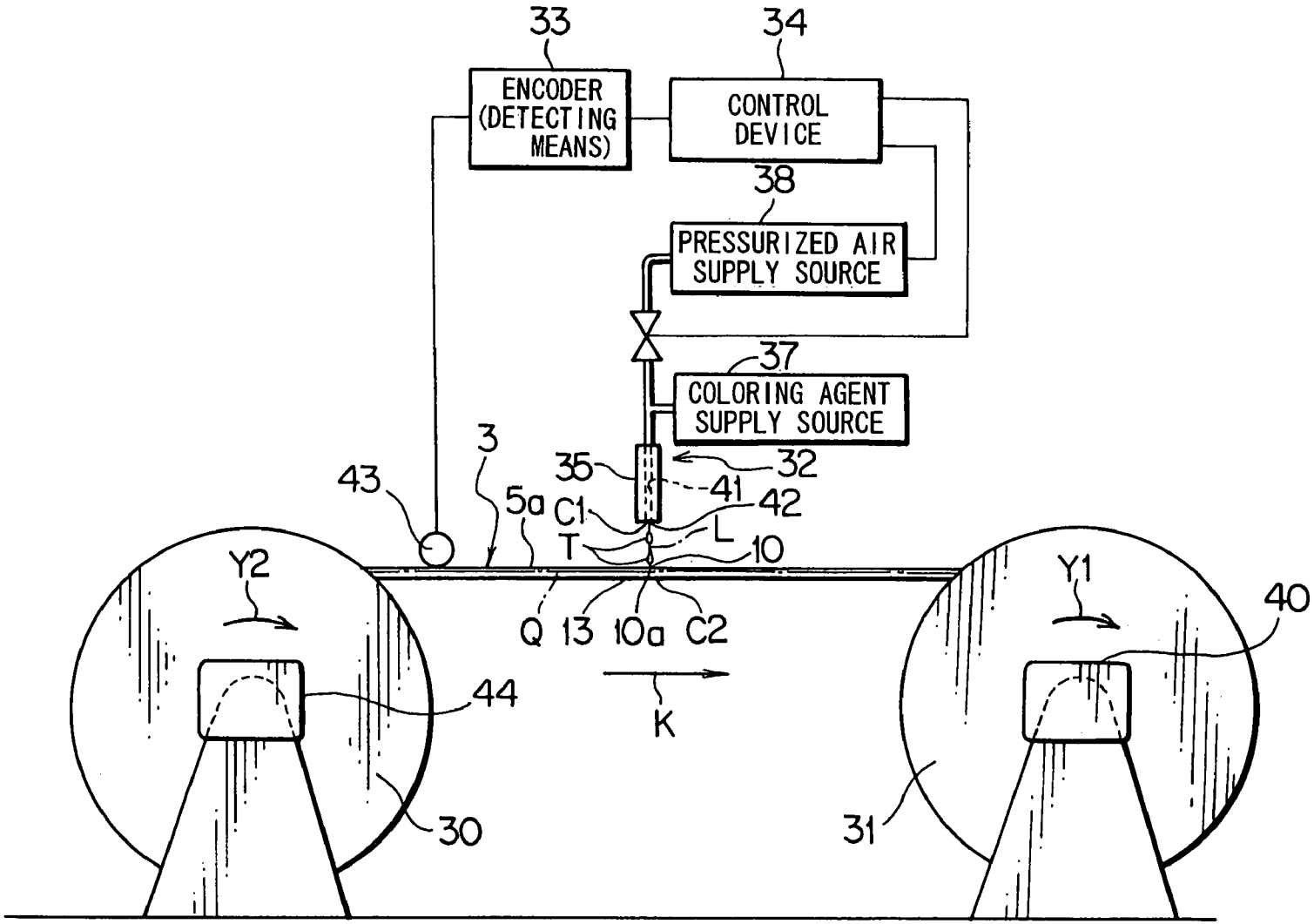
FIG. 7 is an explanatory diagram showing a structure of an apparatus for marking an electric wire according to a second embodiment of the present invention.

Now, referring to FIG. 7, an apparatus 1 for marking an electric wire according to a second embodiment of the present invention will be described. The same components as in the first embodiment will be denoted with the same reference numerals and their description will be omitted.

In the present embodiment, the feeding reel 30 is provided with a motor 44 as the tightening means. The motor 44 rotates the feeding reel 30 in the direction of the arrow mark Y2. The motor 44 tends to rotate the feeding reel 30 with less number of rotation than the number of rotation of the motor 40 which is mounted on the take-up reel 31 as described above.

Because the number of rotation of the motor 40 mounted on the take-up reel 31 is more than the number of rotation of the motor 44 mounted on the feeding reel 30, the electric wire 3 is always pulled toward the take-up reel 31. As the results, the feeding reel 30 rotates in the direction of the arrow mark Y2 with the same number of rotation as the take-up reel 31.

In this manner, the motor 44 which is mounted on the feeding reel 30 tends to rotate the feeding reel 30 with the number of rotation less than the number of rotation of the motor 40 which is mounted on the take-up reel 31, and accordingly, the electric wire 3 is tightened in a state applied with a tensile force in a longitudinal direction. In this embodiment too, the straight line L extending between the center C1 of the open end 42 of the nozzle hole 41 in the nozzle 35 and the center C2 of the electric wire 3 lies along a vertical direction.

In the marking apparatus 1 in the present embodiment, the motors 40 and 44 are driven to rotate the reels 31 and 30 in the directions of the arrow marks Y1 and Y2, enabling the electric wire 3 to be tightened in a state applied with the tensile force in the longitudinal direction. Then, according to the signals from the encoder 33, the control device 34 controls the valve 36 and the pressurized air supply source 38 to inject (inject in drops) the determined amount of the coloring agent T in liquid form to the area 10*a* including the uppermost position 10 of the electric wire 3. The coloring agent T in liquid form which has been adhered moves downward by gravity along the outer face 5*a* of the electric wire 3, before the solvent or dispersion liquid is vaporized, and after the solvent or the dispersion liquid has been vaporized, the band mark 21 is formed on the outer face 5*a* of the electric wire 3.

According to this embodiment, the electric wire 3 is tightened in a state applied with the tensile force in the same manner as in the first embodiment, and therefore, positional displacement of the electric wire 3 can be prevented. The nozzle 35 of the injection unit 32 injects the coloring agent T toward the area 10*a* including the uppermost position 10 of the electric wire 3. In addition, the straight line L extending between the center C1 of the open end 42 of the nozzle hole 41 in the nozzle 35 and the center C2 of the electric wire 3 lies along a vertical direction. For this reason, by providing only one nozzle 35 of the injection unit 32, it is possible to form the band mark 21 on a part of the outer face 5*a* of the electric wire 3 along the entire circumference thereof. Therefore, the marking apparatus 1 can be manufactured at a low cost, and the overall cost for marking the electric wire 3 can be decreased.

In the above described first and second embodiments, the straight line L extending between the center C1 of the open end 42 of the nozzle hole 41 in the nozzle 35 and the center C2 of the electric wire 3 lies along a vertical direction, and the nozzle 35 is positioned right above the electric wire 3. However, in the present invention, it would be sufficient that the nozzle 35 is positioned even a little higher than the electric wire 3. In other words, the nozzle 35 need not necessarily be positioned right above the electric wire 3, provided that the nozzle 35 is anyway positioned higher than the electric wire 3.

Figure 8:
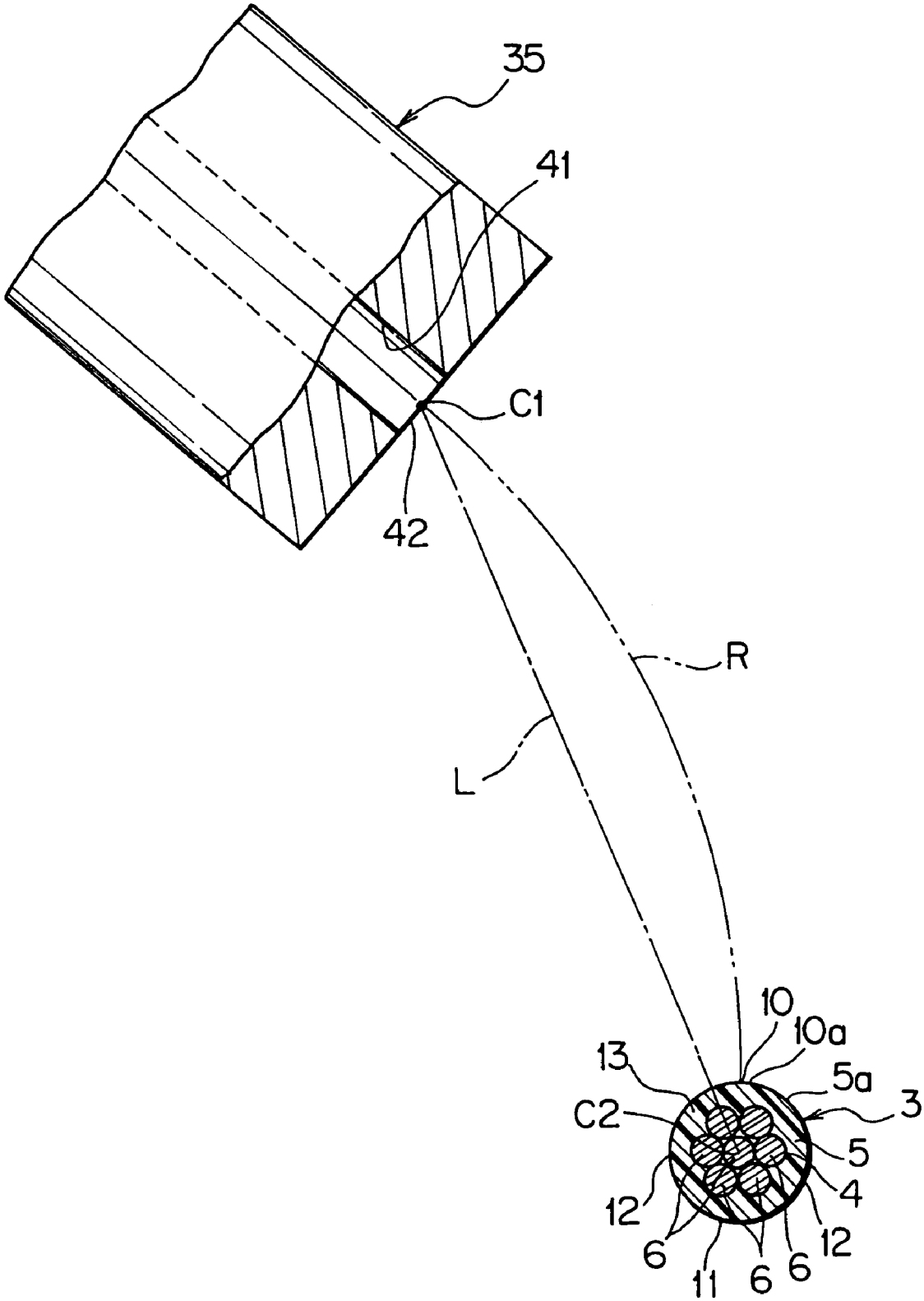
FIG. 8 is an explanatory view showing a modified example of positional relation between a nozzle of the apparatus for marking an electric wire according to the present invention and the electric wire.

In this case, it is desirable that the nozzle 35 is arranged at such a position that the injected coloring agent T can be adhered to the area 10*a* including the uppermost position 10 of the electric wire 3, as shown in FIG. 8. In FIG. 8, a trajectory of the coloring agent T injected from the nozzle 35 is represented by a two dot chain line R. In this case too, the band mark 21 can be formed by employing the single nozzle 35, and the cost for the marking apparatus 1 can be reduced.

Moreover, the coloring agent T injected from the nozzle 35 need not necessarily be adhered to the uppermost position 10. It would be sufficient that the coloring agent T is adhered to the outer face 5*a* positioned in the upper half 13 in cross section of the electric wire 3. It is to be noted that the upper part of the electric wire 3 described in the claims means the upper half 13 which is positioned above the center of the electric wire in cross section.

Figure 9:
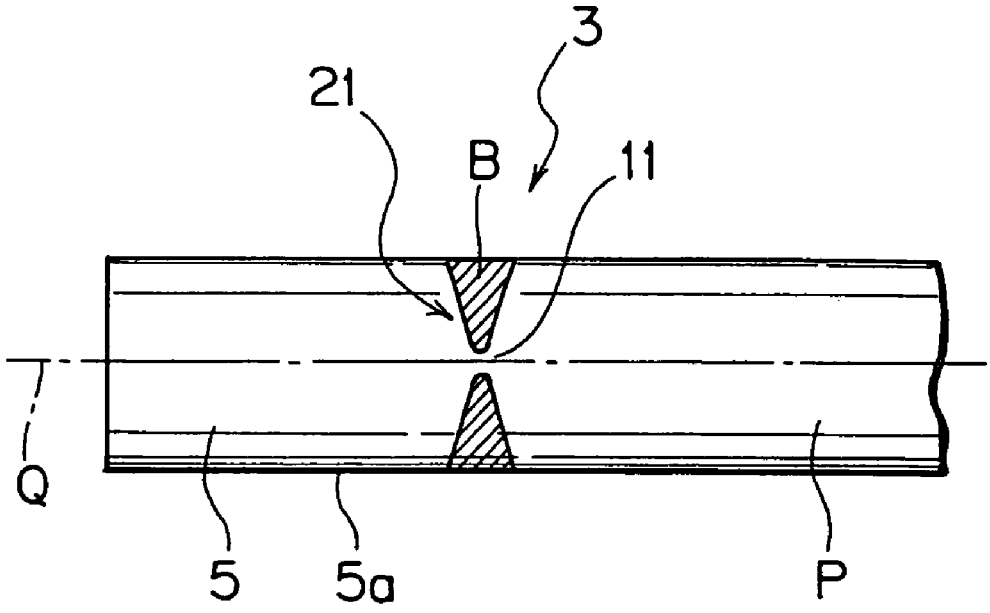
FIG. 9 is a bottom view showing a modified example of the electric wire as shown in FIG. 5.

Further, the band mark 21 is formed on a part of the outer face 5*a* of the electric wire 3 along the entire circumference thereof, in the above described first and second embodiments. However, according to the present invention, as shown in FIG. 9, the coloring agent T which has been spread up to the lower part of the electric wire 3 need not join together, but there may be formed a zone where the coloring agent T does not exist. The description that the coloring agent T is adhered to the entire circumference or substantially entire circumference of the outer face 5*a* of the electric wire 3 means both that the coloring agent T is adhered to the outer face 5*a* along the entire circumference thereof, and that there is formed the zone where the coloring agent T does not exist.

In the first and second embodiments as described above, only one injection unit 32 is provided. However, according to the present invention, it is apparent that a plurality of injection units 32 may be provided, and a plurality of band marks 21 may be formed on the outer face 5*a*, by employing a plurality of coloring agents, in short, with a plurality of colors.

Further, in the first and second embodiments as described above, the control device 34 includes a computer provided with ROM, RAM, CPU, etc. However, according to the present invention, the control device 34 may include a known digital circuit or the like. In this case, it is necessary to employ a circuit for counting the pulse signals from the aforesaid encoder 33, and a circuit for deciding whether the aforesaid valve 36 is to be opened or closed when the pulse signal of a certain number has been inputted.

It would be also apparent that the marking apparatus 1 in the first and second embodiments can be mounted on various types of working machines which are employed in a wire harness assembling process, such as an electric wire cutting device in which a determined length of the electric wire 3 is fed and cut.

Moreover, the present invention has been described as applied to the electric wire 3 which forms the wire harness to be arranged in an automobile in the first and second embodiments. However, it is apparent that the electric wire 3 may be employed not only in the automobile but also in various types of electronic units such as a portable computer, or various types of electric machines, according to the present invention.

Further, the coloring liquid and paint may includes acrylic paint, ink (dye, pigment), UV ink, etc. according to the present invention.

INDUSTRIAL APPLICABILITY

As fully described herein above, according to the present invention, the electric wire is tightened with the tensile force, and therefore, positional displacement of the electric wire can be prevented. As the results, the coloring agent which has been injected toward the upper part of the outer face of the electric wire can be reliably adhered to this upper part of the electric wire. The coloring agent which has been adhered to the upper part of the electric wire reliably moves downward by gravity in a state adhered to the outer face of the electric wire. Therefore, by providing only one means or mechanism for injecting the coloring agent, it is possible to adhere the coloring agent to a part of the outer face of the electric wire along entire circumference thereof. Accordingly, the band mark can be formed by providing only one means or mechanism for injecting the coloring agent, and so, the overall cost for marking the electric wire can be decreased.

According to the present invention, the coloring agent is injected toward an area located at the uppermost position of the electric wire. Therefore, the coloring agent which has been adhered to the electric wire reliably moves downward by gravity in a state adhered to the outer face of the electric wire. Therefore, by providing only one means or mechanism for injecting the coloring agent, it is possible to adhere the coloring agent reliably to a part of the outer face of the electric wire along entire circumference thereof. Accordingly, the band mark can be formed by providing only one means or mechanism for injecting the coloring agent, and so, the overall cost for marking the electric wire can be decreased.

According to the present invention, the line extending between the center of the open end and the center of the electric wire lies along a vertical direction. Therefore, the open end is positioned right above the electric wire. As the results, the coloring agent is reliably adhered to the uppermost position of the electric wire. Therefore, the coloring agent which has been adhered to the electric wire moves downward more reliably by gravity in a state adhered to the outer face of the electric wire. Therefore, by providing only one means or mechanism for injecting the coloring agent, it is possible to adhere the coloring agent more reliably to a part of the outer face of the electric wire along entire circumference thereof. Accordingly, the band mark can be formed by providing only one means or mechanism for injecting the coloring agent, and so, the overall cost for marking the electric wire can be decreased.

According to the present invention, the electric wire is tightened by the tightening means. Therefore, positional displacement of the electric wire can be prevented. The injecting means is positioned above the electric wire and injects the coloring agent toward the upper part of the electric wire. As the results, the coloring agent can be reliably adhered to the upper part of the electric wire. The coloring agent which has been adhered to the upper part of the electric wire moves downward by gravity in a state adhered to the outer face of the electric wire. For this reason, by providing only one injecting means, it is possible to adhere the coloring agent to a part of the outer face of the electric wire along the entire circumference thereof. Accordingly, because the band mark can be formed by providing only one means for injecting the coloring agent, the marking apparatus for the electric wire can be manufactured at a low cost, and the overall cost for marking the electric wire can be decreased.

According to the present invention, the injecting means injects the coloring agent toward an area located at the uppermost position of the electric wire. Therefore, the coloring agent which has been adhered to the electric wire reliably moves downward by gravity in a state adhered to the outer face of the electric wire. For this reason, by providing only one means for injecting the coloring agent, it is possible to adhere the coloring agent to a part of the outer face of the electric wire along the entire circumference thereof. Accordingly, because the band mark can be formed by providing only one means for injecting the coloring agent, the marking apparatus for the electric wire can be manufactured at a low cost, and the overall cost for marking the electric wire can be decreased.

According to the present invention, the line extending between the center of the open end of the injecting means and the center of the electric wire lies along a vertical direction. Therefore, the open end of the injecting means is positioned right above the electric wire. As the results, the coloring agent can be reliably adhered to the uppermost position of the electric wire. Therefore, the coloring agent which has been adhered to the electric wire moves downward by gravity in a state adhered to the outer face of the electric wire, more reliably. For this reason, by providing only one means for injecting the coloring agent, it is possible to adhere the coloring agent to a part of the outer face of the electric wire along the entire circumference thereof. Accordingly, because the band mark can be formed by providing only one means for injecting the coloring agent the marking apparatus for the electric wire can be manufactured at a low cost, and the overall cost for marking the electric wire can be decreased.

The invention claimed is:

1. A method for marking an electric wire which includes an electrically conductive core wire and an insulating sheath, by injecting a certain amount of coloring agent to an outer face of said electric wire, wherein said electric wire is tightened in a state where a tensile force is applied in a longitudinal direction, and said coloring agent is injected in drop form from an upper side of said electric wire onto an upper part of the outer face of said electric wire to form a band as a mark as a ring on the electric wire, with the drop contacting the uppermost portion of the upper part and moving downwardly by gravity along the outer face to form the band, which gradually becomes narrower from above to below the outer face.

2. The method for marking an electric wire as claimed in claim 1, wherein said coloring agent is injected through an open end of a nozzle which is opposed to the outer face of said electric wire, and a line extending between a center of said open end and a center of said electric wire lies along a vertical direction.

3. A method for marking an electric wire, which includes an electrically conductive core wire and an insulating sheath, by injecting a certain amount of coloring agent to an outer face of said electric wire, wherein said electric wire is tightened in a state where a tensile force is applied in a longitudinal direction, and said coloring agent is injected in drop form from an upper side of said electric wire onto an upper part of the outer face of said electric wire to form a band as a mark on the electric wire, with the drop contacting the uppermost portion of the upper part and moving downwardly by gravity along the outer face to form the band, and wherein an uppermost portion of the mark has a width larger than a width of the mark at a lowermost portion of the mark, in a longitudinal direction of the electric wire.

* * * * *